US006267240B1

(12) United States Patent
Callaway

(10) Patent No.: US 6,267,240 B1
(45) Date of Patent: Jul. 31, 2001

(54) ILLUMINATED PORTABLE TOOL BOX

(76) Inventor: Roscoe Callaway, 1503 Conoga St., Norfolk, VA (US) 23523

( * ) Notice: Subject to any disclaimer, the term of this patent is extended or adjusted under 35 U.S.C. 154(b) by 0 days.

(21) Appl. No.: 09/495,839

(22) Filed: Feb. 1, 2000

Related U.S. Application Data

(60) Provisional application No. 60/012,597, filed on Mar. 1, 1996.

(51) Int. Cl.[7] ..... B65D 85/28

(52) U.S. Cl. ..... 206/373; 362/154

(58) Field of Search ..... 206/349, 372, 206/373, 573; 362/154, 156

(56) References Cited

U.S. PATENT DOCUMENTS

| | | | | |
|---|---|---|---|---|
| 3,772,527 | * | 11/1973 | Darling et al. . | |
| 3,938,132 | | 2/1976 | Cunningham | 340/321 |
| 4,340,985 | | 7/1982 | Potter | 5/442 |
| 4,855,881 | | 8/1989 | Pence | 362/156 |
| 5,219,446 | | 6/1993 | Klepac | 362/154 |
| 5,459,648 | * | 10/1995 | Courtney | 362/154 |
| 5,624,029 | | 4/1997 | Shih | 206/372 |
| 5,685,421 | | 11/1997 | Gilmore | 206/216 |
| 5,879,072 | * | 3/1999 | Huang | 362/156 |
| 6,053,315 | * | 4/2000 | Yao | 206/372 |

* cited by examiner

*Primary Examiner*—David T. Fidei
(74) *Attorney, Agent, or Firm*—Baker Botts L.L.P.

(57) ABSTRACT

A portable tool box includes an integral utility light for illuminating the worksite, and also provides a pair of head rest areas for the user. An on-off switch for the light is provided within finger-reach of the carrying handle for the tool box. The utility light is a fish-eye type mounted in a ball-swivel mount on an inclined portion of the tool box lid.

9 Claims, 4 Drawing Sheets

ILLUMINATED PORTABLE TOOL BOX

REFERENCE TO PRIOR APPLICATION

The present application is based on U.S. Provisional Patent Application Ser. No. 60/012,597, filed Mar. 1, 1996.

BACKGROUND OF THE INVENTION

Portable tool boxes are widely used by tradesmen, homeowners, automobile owners and handymen for storing and carrying tools to a work site or in emergencies. Often the place of use is poorly illuminated, e.g., under houses or fixtures, in attics, at roadsides at night, and the like. In such cases, it is desirable that the tool box include an integral utility light for illuminating the work site. It is also frequently necessary for the workman to lie on his back while working, as, for example, when he must work under a fixture, automobile or other obstruction. In these situations, it is desirable to provide the workman a convenient place to rest his head while working, both to facilitate work and to ease fatigue.

SUMMARY

In accordance with the invention, a portable tool box is provided which includes an open-topped base portion for containing tools and the like, a lid hinged to the base portion and having an inclined portion adjacent one sidewall of the base portion, a carrying handle mounted in the lid, and an electric light mounted on the inclined portion of the lid in a ball-swivel type mount for manual adjustment of the light beam in all directions. Preferably, the inclined lid portion, and thus the light, is located adjacent the base portion sidewall opposite to the hinged end of the lid, with the inclined portion being inclined towards the hinged end.

In a preferred embodiment, the carrying handle is mounted on the lid between the inclined portion and the hinged end of the lid. An on-off switch for the light is located within finger reach of the carrying handle, so that a user may carry the tool box and operate the light switch with the same hand. Preferably, the base portion includes a compartment for a power supply for the electric light.

In accordance with another feature of the invention, the portions of the lid on both sides of the carrying handle are recessed to provide a pair of head rest areas. The unrecessed portion of the lid between the head rest areas, which in the preferred embodiment underlies the handle, provides in its undersurface a wire guide for the electrical conductors leading from the power supply to the electric light. The power supply may be either rechargeable or non-rechargeable. If the former, a recharge adapter is also provided, and the unrecessed portion of the lid adjacent the hinged end may constitute a storage area for the recharge adapter.

BRIEF DESCRIPTION OF THE DRAWINGS

For a more complete understanding of the invention and the advantages thereof, reference may be made to the following written description of an exemplary embodiment, taken in conjunction with the accompanying drawings.

DESCRIPTION OF EXEMPLARY EMBODIMENT

Figure 3:
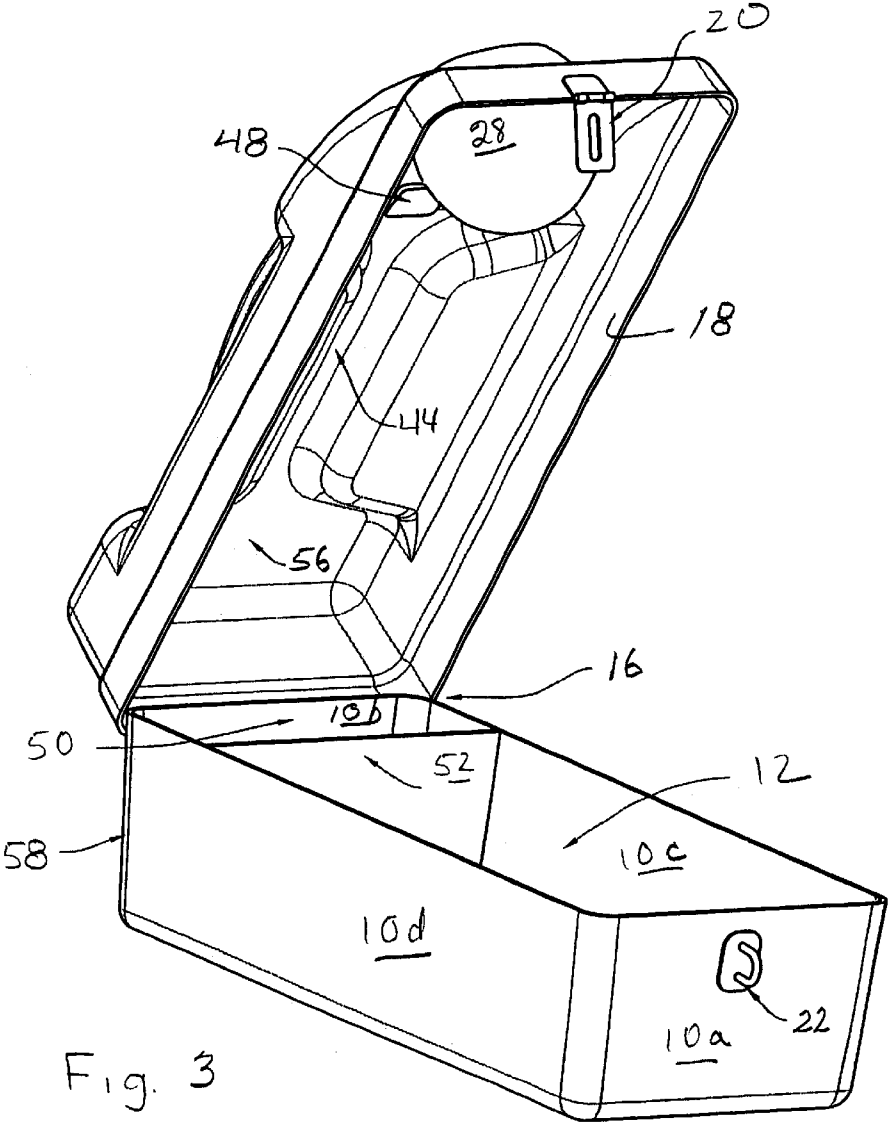
FIG. 3 is a perspective view of the embodiment of FIG. 1, with the lid in the open position and with the power supply and electrical conductors omitted for clarity of illustration.
Figure 4:
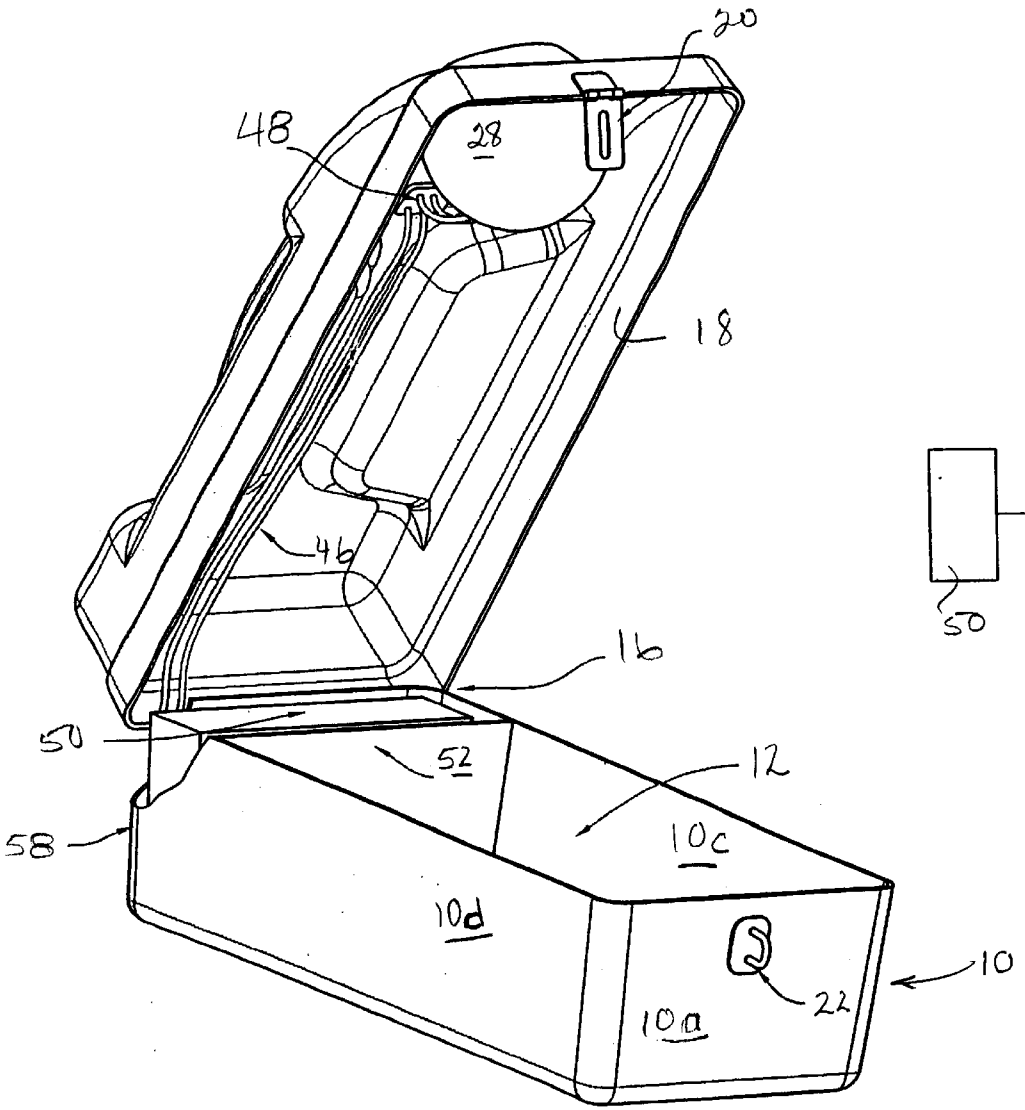
FIG. 4 is a perspective view similar to FIG. 3, but showing the power supply and the electrical conductors in place.

In the embodiment of the tool box shown in the drawings, a base portion 10 has a first pair of sidewalls 10*a*, 10*b*, a second pair of sidewalls 10*c*, 10*d* and a bottom wall (not shown). As shown in FIGS. 3 and 4, the upper end of the base portion 10 is open, so that the sidewalls 10*a*–10*d* and the bottom wall define a recessed storage area 12 for receipt of tools or the like. Preferably, the upper ends of the sidewalls 10*a*–10*d* lie in a common plane.

Figure 2:
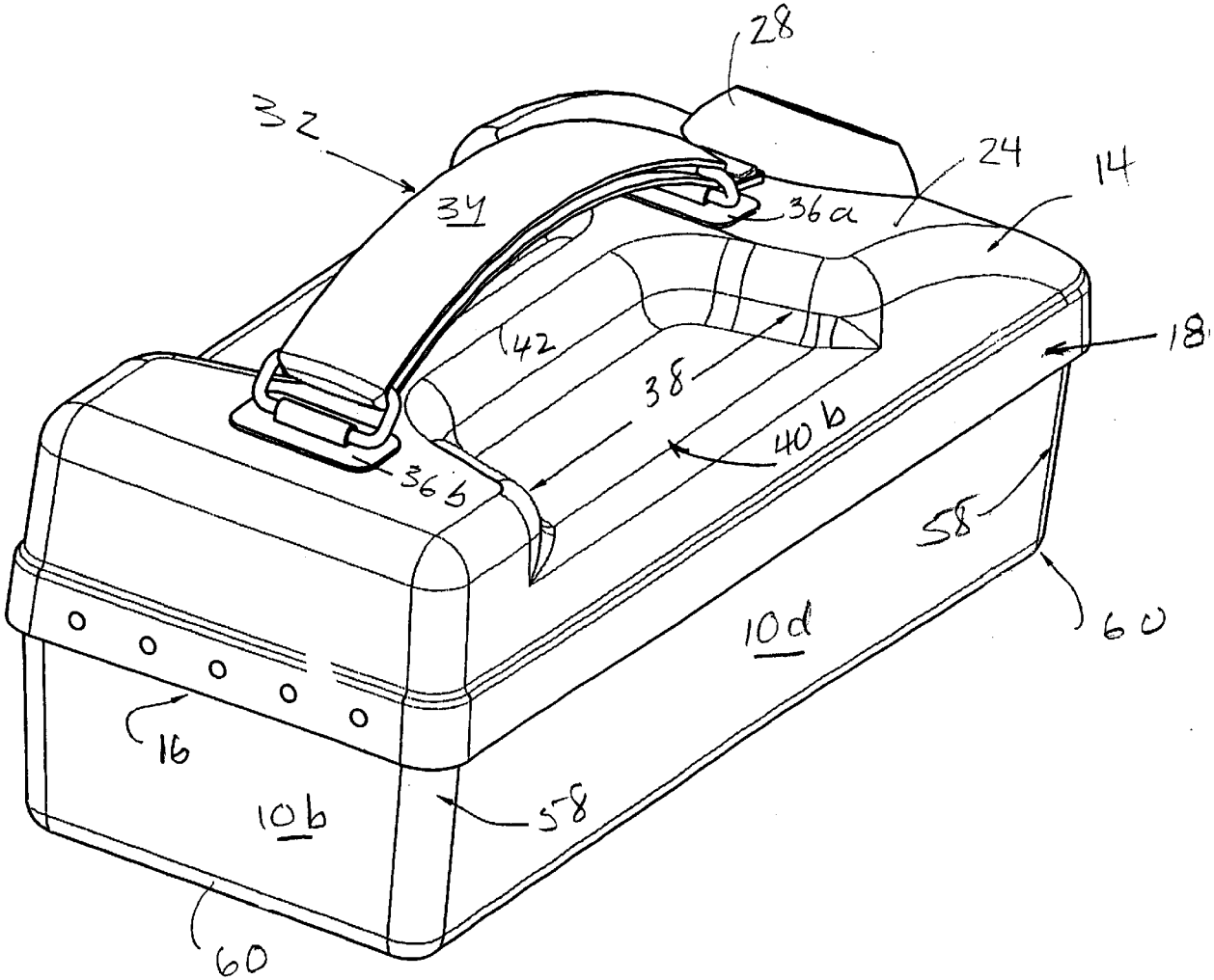
FIG. 2 is a rear perspective view of the embodiment of FIG. 1.

The open upper end of the base portion 10 is closed by a lid 14 that is hinged in a conventional manner to the upper end of the sidewall 10*b* as illustrated at 16 in FIG. 2. The lid 14 has a cross sectional configuration in plan which corresponds to that of the open upper end of the base portion 10 such that, when closed, the lid 14 overlaps the upper ends of the sidewalls 10*a*–10*d*. To that end, the lid 14 may be formed with a peripheral lip 18 which extends downward over the sidewalls 10*a*–10*d* to insure a tight fit to the base portion 10.

At the sidewall 10*a* opposite to the hinge 16, the lid 14 and the base portion 10 are provided with a releasable catch for releasably securing the lid 14 in the closed position. In the embodiment shown, the catch is a conventional hasp having a slotted metal strap 20 carried by the lid 14 which fits over a staple 22 carried by the base portion 10. Any other suitable releasable catch, e.g. a manual latch, may be used if desired. Also, more than one catch may be provided, as, for example, on the sidewalls 10*c* and 10*d* instead of or in addition to the sidewall 10*a*.

Figure 1:
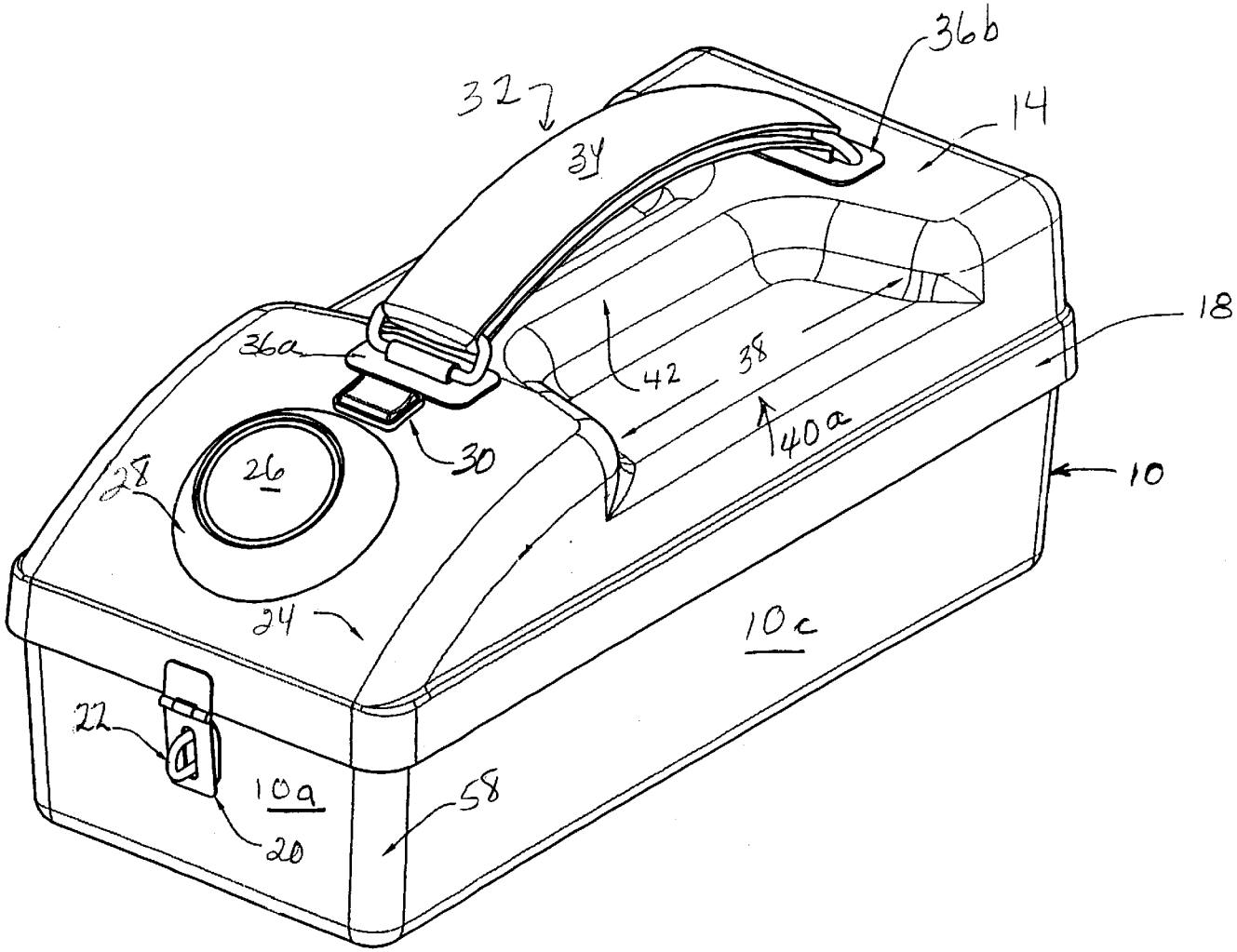
FIG. 1 is a front perspective view of one embodiment of a portable tool box in accordance with the invention, with the lid in the closed position.

As shown in FIGS. 1 and 2, the portion 24 of the lid 14 adjacent to the sidewall 10*a* of the base portion 10 is preferably inclined, i.e., slopes or curves, relative to the bottom wall of the base portion 10 in the direction of the hinged end of the lid at the sidewall 10*b*. Located on the inclined portion 24 is an electrical light 26, preferably of the fish-eye type that is mounted in a ball-swivel mount 28. The combination of the inclination of the lid portion 24 and the ball-swivel mount of the light 26 enables the light to be manually adjustable to position the light beam in any desired direction over an angle of 360° in the plane of the inclined portion 24 and over 180° in a plane perpendicular to the plane of the portion 24.

Adjacent to the light 26 is an on-off switch 30 which is mounted on the inclined lid portion 24. As shown, the switch is of the push-button type, but may be of any suitable type, e.g. a toggle switch or a rotary switch.

Next to the switch 30, a carrying handle 32 is mounted to the lid 14, extending from the inclined lid portion 24 towards the hinged end of the lid 14. The handle 32 includes a hand grip strap 34 and a pair of end brackets 36*a* and 36*b* coupling the strap to the lid 14. In accordance with the invention, the handle 32 is located close enough to the switch 30 to be within finger reach thereof by a user gripping the handle. This allows the user to turn the light 26 on and off while carrying or positioning the tool box 10 with the same hand.

As shown in FIGS. 1 and 2, the upper surface of the lid 14 adjacent the upper end of each of the sidewalls 10*c* and 10*d* is recessed over a substantial distance 38, in the direction between the sidewalls 10*a* and 10*b*, to form two headrest areas 40*a*, 40*b*. When it is desirable or necessary for a workman to lie on his back or side while working, as when he is working under a vehicle, home fixture or the like, the workman may rest his head on either of the head rest areas 40*a*, 40*b* and, at the same time, direct the light 26 upward or towards the side as needed.

Figure 5:
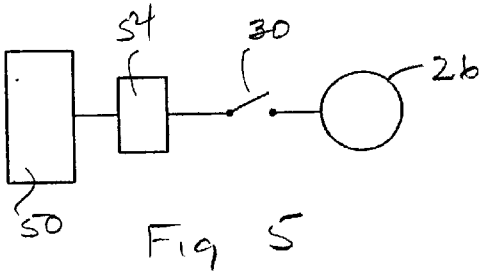
FIG. 5 is a schematic illustration of a rechargeable power supply and the associated electrical circuit for the light.

The unrecessed region 42 of the lid 14 between the head rest areas 40*a*, 40*b* forms, on its underside 44 (see FIG. 3) a wire guideway for electrical conductors 46 (see FIG. 4) leading to the light 26. As best seen in FIG. 4, the conductors 46 lead from the input connector 48 of the light 26 to a battery or other power supply 50 in the base portion 10. Preferably, one or more partitions 52 are provided in the base portion 10 to form a storage compartment for the battery 50. The battery 50 may be either of the rechargeable type or the non-rechargeable type. If rechargeable, an electrical input (not shown) may be provided in the base portion 10 for connection to an outside electrical supply to charge the battery. A conventional recharge adapter 54 (see FIG. 5) may also be provided. The unrecessed lid region 56 which overlies the battery storage compartment 50 provides a convenient storage area for the recharge adapter 54. Alternatively, the adapter may be located in the battery compartment 50. A basic electrical circuit including the battery 50, the recharge adapter 54, the switch 30 and the light 26 is shown in FIG. 5.

The base portion 10 and the lid 14 are preferably fabricated of extruded plastic material. As shown in FIG. 1, the corners 58 between the base portion sidewalls 10*a*–10*d* and the corners between the sidewalls 10*a*–10*d* and the bottom wall are rounded for safety and ease of use. The corners and ends of the lid 14 arc similarly rounded.

Although the invention has been described herein by reference to specific embodiments thereof, it will be understood that such embodiments are susceptible of modification and variation without departing from the inventive concepts disclosed. All such modifications and variations, therefore, are intended to be included within the spirit and scope of the appended claims.

What is claimed is:

1. A portable tool box, comprising:

a base portion having an open top, first and second pairs of opposed side walls and a bottom wall defining a recessed storage area;

an upper lid having a configuration corresponding to the open top of said base portion and being hinged to said base portion at one of said first pair of side walls for movement between an open position and a closed position relative to said base portion, said lid having a first portion thereof which is inclined relative to the bottom wall of the base portion;

at least one releasable catch carried in part by said lid and in part by said base portion for releasable securing said lid to said base portion in the closed position of said lid;

the upper surface of said lid being recessed adjacent each of said second pair of opposed side walls of said base portion to provide a pair of head rest areas on said lid;

a carrying handle mounted on said lid;

an electric light mounted on said inclined first portion of said lid in a ball-swivel mount for manual movement of the light beam in all directions; and the underside of said lid portion between said pair of head rest areas comprising a wire guideway for electrical connection to said light.

2. The tool box of claim 1, wherein:

said inclined first portion of said lid is located adjacent the other sidewall of said first pair of sidewalls of said base portion; and said first portion of said lid is inclined in the direction towards said one sidewall and away from said other sidewall of said first pair of sidewalls.

3. The tool box of claim 2, wherein said handle is mounted on said lid at a location between said electric light and the side of said lid that is hinged to said base portion.

4. The tool box of claim 3, further comprising a manual on-off switch for said electric light, said switch being mounted on said lid at a location between said light and the adjacent end of said handle.

5. The tool box of claim 4, wherein said switch is located within finger reach of said handle.

6. The tool box of claim 5, wherein said base portion includes at least one interior partition bounding a storage area for a power supply for said light.

7. The tool box of claim 1, wherein said handle overlies the portion of said lid located between said pair of head rest areas.

8. The tool box of claim 7, further comprising:

a storage compartment in said base portion for a power supply for said light; and one or more electrical conductors leading from said storage compartment through said wire guideway to said light for supplying power to said light.

9. The toolbox of claim 6, wherein the portion of the lid overlying said power supply storage area comprises a storage area for a battery recharging unit.

* * * * *